US006900431B2

(12) United States Patent
Belov et al.

(10) Patent No.: US 6,900,431 B2
(45) Date of Patent: May 31, 2005

(54) MULTIPLEXED ORTHOGONAL TIME-OF-FLIGHT MASS SPECTROMETER

(75) Inventors: Mikhail Belov, Burlingame, CA (US); Charles A. Fancher, San Jose, CA (US); Peter Foley, Los Altos Hills, CA (US)

(73) Assignee: Predicant Biosciences, Inc., South San Francisco, CA (US)

( * ) Notice: Subject to any disclaimer, the term of this patent is extended or adjusted under 35 U.S.C. 154(b) by 0 days.

(21) Appl. No.: 10/395,023

(22) Filed: Mar. 21, 2003

(65) Prior Publication Data

US 2004/0183007 A1 Sep. 23, 2004

(51) Int. Cl.[7] ..... H01J 49/40
(52) U.S. Cl. ..... 250/282; 250/287; 702/23
(58) Field of Search ..... 250/282, 287; 702/23, 27

(56) References Cited

U.S. PATENT DOCUMENTS 5,396,065 A * 3/1995 Myerholtz et al. ..... 250/287
5,652,427 A * 7/1997 Whitehouse et al. ..... 250/282
6,300,626 B1 * 10/2001 Brock et al. ..... 250/287

OTHER PUBLICATIONS

Mlynski et al., Matrix–assisted Laser/Desorption Ionization Time–of–flight Mass Spectrometer with Orthogonal Acceleration Geometry: Preliminary Results, Rapid Communications in Mass Spectrometry, (1996) vol. 10 1524–1530.

OTOF Description, Pacific Northwest Laboratroy, printed from internet Jan. 1, 2003 <<http://www.emsl.pnl.gov.2080/docs/msd/fticr/OTOF_Description.html>>.

Selby et al., Demonstrating the effect of the 'polarised grid geometry' for orthogonal acceleration time–of–flight mass spectrometers, Rapid Commun. Mass Spectrom, (2000) vol. 14, pp. 616–617.

Selby et al., Direct Quantification of Alkaloid Mixtuers by Electrospray Ionization Mass Spectrometry, J. Mass Sectrom, (1998) vol. 33, 1232–1236.

Sharara et al., Development of membrane introduction mass spectrometry for monitoring trace organics in water, Water Science and Technology, (2000) vol. 41, No. 10–11, pp. 373–380.

* cited by examiner

*Primary Examiner*—Jack I. Berman
(74) *Attorney, Agent, or Firm*—Townsend & Townsend & Crew LLP; Mark D. Barrish, Esq.

(57) ABSTRACT

A mass spectrometer and associated methods analyze an ion beam by accumulating ions for a sequence of time periods, and driving the accumulated ions in pulses. Differing quantities of ions can be accumulated in the sequential pulses according to a psuedo-random sequence, and the slower ions are overtaken by the faster ions of a subsequent pulse. A mass spectrum may be reconstructed from an overlapping ion detector signal using an inverse of a weighted simplex matrix or inverse Hadamard transform techniques.

19 Claims, 7 Drawing Sheets

MULTIPLEXED ORTHOGONAL TIME-OF-FLIGHT MASS SPECTROMETER

BACKGROUND OF THE INVENTION

The present invention generally relates to devices and methods for characterizing sample materials. In an exemplary embodiment, the invention provides a time-of-flight (TOF) mass spectrometer that allows overlapping packets of ions to be mathematically resolved into a mass spectrum. A variety of related methods, devices, and systems are also provided.

Mass spectrometers are widely used in research for characterization and identification of biological compositions and biological substances. Mass spectrometers often analyze variations or dispersions of ion movement under electric or magnetic fields, and are particularly useful for determining properties such as molecular mass of ions and sequence information of interest.

A wide variety of ionization sources have been developed, with many of these of being intended for ionization of biological compounds. Ion sources often make use of vacuum chambers to ionize the compounds of interest at very low pressures using electrical field ionization, thermal ionization, photo-ionization, and other techniques. More recently, characterization of complex biological compounds has been advanced by the introduction of ionization sources operating at elevated pressures, including atmospheric pressure. Such pressure environments may provide efficient and "soft" ionization of large complex biological substances, e.g., proteins. Electrospray ionization (ESI) is among the most popular atmospheric pressure ionization techniques, although matrix assisted laser desorption ionization (MALDI) and related techniques have also found beneficial applications in atmospheric and intermediate pressure ranges.

A variety of analyzer technologies have been developed, including analyzers which measure the travel time or "time-of-flight" of ions along a flight path, i.e., TOF instruments. In general, as biological research has expanded in the field of proteomics it has become desirable to develop analyzers which would contribute to a more complete understanding of protein functions in a cellular context. Toward that end, it would be advantageous to provide high sensitivity, a wide dynamic range, and an improved duty cycle so as to facilitate the study of cellular pathways, as many important protein classes are present at quite low concentrations.

A wide variety of mass spectrometer analyzers may be coupled to an ESI (or other) ion source, including Fourier transform ion cyclotron resonance (FTICR), quadrupole ion storage trap, and TOF mass spectrometers. FTIR mass spectrometers may provide baseline isotopic mass resolutions of proteins with molecular masses up to 10 kDa, and may detect sub attomole (less than 600,000 molecules) quantities of proteins at a very high duty cycle. However, FTICR mass spectrometers have limitations on the speed of analysis. Shortening the detection time (and therefore truncating the ion signal transients) would deteriorate mass resolution, making these analyzers better suited for extended separation times.

Alternative known mass analyzers also have drawbacks in either speed or performance. For example, quadrupole ion trap mass spectrometers may provide a higher speed analysis than FTICR, but may be limited to a lower resolution and dynamic range. While improvements in resolution and sensitivity can be provided, these improvements generally results in decreases in the duty cycle and the speed of analysis. TOF mass spectrometers with orthogonal acceleration (OA-TOF) may provide both high-speed analysis and relatively high-mass resolution, along with high sensitivity. However, these instruments generally send packets of ions toward a detector in a "release and wait" approach, yielding a limited duty cycle. Hence, each of these known analyzer technologies has significant limitations with respect to rapid quantitative analysis of protein extracts.

A new time-of-flight mass spectrometer has recently been developed in an attempt to address some of the limitations of prior analyzer structures. The Hadamard transform TOF mass spectrometer makes use of a Bradbury-Nielsen Gate disposed along the ion path so as to encode a continuous ion beam with an on-axis "on" and "off" pseudo-random binary sequence, followed by mathematical recovery of the acquired signal.

In general, mass spectrometers have evolved over the years to highly accurate (albeit complex) research tools. Further improvements in existing mass spectrometry instruments for use by researchers will continue to be beneficial. Moreover, it may be possible to transfer at least some of these improvements more directly into improved healthcare. This technology transfer may involve a fundamental shift; medical diagnosis may in the future make use of mass spectrometry, which has basically been a research tool. For example, it may be possible to use improved mass spectrometers to identify the presence of small quantities of a particular protein or set of proteins (or other marker substances) which can reliably detect or predict a specific biological state in a patient (such as cancer or other disease states) earlier and/or more reliably than conventional approaches. To enable this very different use, the reliability, ease of use, and reproducibility of biological sample analysis by existing research mass spectrometers should be dramatically improved. Additionally, it would be highly beneficial to provide a combination of good mass resolution, high sensitivity, and accuracy with a faster analysis time and throughput so as to allow a significant number of samples (for example, from a large number of patients) to be analyzed in a given amount of time by a single system.

For the reasons given above, it would be desirable to provide improved devices, methods, and systems, for characterizing biological and other samples. It would be particularly beneficial to provide improved mass spectrometers and mass spectrometry analysis methods, especially if these improvements provided a combination of good mass resolution, sensitivity and accuracy, together with a short analysis time so as to facilitate a high throughput of samples.

BRIEF SUMMARY OF THE INVENTION

The present invention generally provides improved devices, systems, and methods, for characterizing sample materials. An exemplary embodiment of the invention includes an improved mass spectrometer and associated methods for analyzing an ion beam. The exemplary mass spectrometer accumulates ions in an accumulation region for a sequence of accumulation periods or intervals, and extracts the accumulated ions in packets, often driving the packets laterally relative to an incoming continuous ion beam. The accumulation region may be filled to a varying degree by ions from the incoming ion beam, depending on differing durations of the accumulation periods. When the accumulation time periods have different lengths, differing quantities of ions may be accumulated and extracted by, the sequential extraction pulses. When intermittently extracting the ion packets according to a maximum length pseudo-random sequence (MLPRS), the slower ions of a particular pulse can be overtaken along a flight tube by the faster ions of a subsequent pulse. The overlapping temporal distributions of ion packets will generate a signal at an ion detector. Mass spectra may be resolved from the signal, optionally using inverse Hadamard transform techniques, a generalized inverse matrix approach, or the like. Such a system can provide mass resolution and mass accuracy previously provided only by "wait-and-release" mass spectrometer technologies.

In a first aspect, the invention provides a method for analyzing an ion beam from a sample. The method comprises accumulating ions from the beam for a sequence of differing accumulation periods. The accumulated ions of each accumulation period are accelerated in an associated ion packet. The accelerated ions are detected at a detector, with the ions of sequential packets being intermingled at the detector. The sample is characterized with the intermingled detected ions.

Generally, the characterizing step will comprise recovering or resolving a mass spectrum (using "mass spectrum" term is important because there is also a TOF spectrum) of the sample from the intermingled ions using differing accumulation periods. The packets may have different ion quantities accumulated during the different periods, and the detector will generally transmit a signal in a response to the intermingled ions. The accumulation and extraction of the ions modulates the signal in part in response to the different quantities. The mass spectrum recovering step may comprise demodulating the signal based at least in part on the differing quantities of ions. The mass spectrum recovering step can comprise mathematical conversion of the acquired ion signal to a mass spectrum based at least in part on the different quantities of ions. The sequence of different time periods may comprise a pseudo-random sequence, often comprising a MLPRS. The characterizing step may comprise applying an inverse matrix, with the inverse matrix being an inverse of a matrix which is based on a simplex matrix of the sequence, but with the values modified in correlation with the accumulation periods. Alternatively, uniform accumulation periods may also be employed. The characterizing step may comprise applying an inverse Hadamard transform matrix.

The accumulating, accelerating, and detecting steps may be repeated for a plurality of sequences, with each sequence defining a scan. In many embodiments, the same sequence is repeated from scan to scan. The accelerated ions may travel along a flight path such that flight times of the ions to the detector vary with characteristics of the ions, and the characterizing step may comprise recovering a mass spectrum of at least one sequence from the intermingled ions. In many embodiments, the characterizing step will comprise combining a plurality of scans, typically before mathematical manipulation so as to minimize statistical variations.

In many embodiments, the accumulation periods may comprise integer multiples of a sequence time unit. The characterizing step may comprise separating each time unit into a plurality of sampling time bins. The detected intermingled ions may each have an associated sampling time bin. A plurality of sampling matrices may be assembled, with the number of sampling matrices associated with the number of sampling time bins from each time unit. These sample matrices may be individually manipulated using an inverse matrix corresponding to the sequence. The spectrum may then be assembled from the manipulated matrices.

The ion beam will often be oriented along an axis, and the accelerated ions may travel along a flight path which is laterally oriented relative to the axis. The ion beams may travel along the axis from an ion source, and the accelerating stop may comprise extracting the ions along a second axis which is orthogonal to the first axis. An accumulation region may extend along the first axis, and the detector may detect arrival to the ions onto a detector surface extending along the first axis and across the flight path of the ions. Accelerating the ions may comprise applying an orthogonal acceleration potential after each of the accumulation periods of the sequence. The detector may be positioned along the flight path at an ion focal length defined by the acceleration potential and of the spacings between acceleration electrodes. An ion reflector may be disposed along the ion flight path between the accumulation region and the detector.

Ions may be directed along a path of the ion beam to an accumulation region with first and second multi-pole rf-ion guides at differing ambient pressures. The first multi-pole rf-ion guide may provide collisional focusing of the ions of beam. A second multi-pole rf-ion guide may selectively filter at least a portion of the ions of the beam. Filtering of the ions may be varied in response to detecting of the ions in a feedback loop. Desolvating of the ions may be performed in a heated capillary. The resulting ion species can be transported toward an exit orifice of an electrodynamic ion funnel using an axial DC-gradient and radial confining RF-field applied to the ion funnel electrodes. Ions exiting the funnel may then be transmitted by multiple RF-field ion guides through a plurality of decreasing ambient pressures with a plurality of pump-down stages, and electrostatically steered and focused toward the accumulation region.

In another aspect, the invention provides a spectrometry method comprising accumulating ions from an ion beam. Packets of the accumulated ions are accelerated according to a sequence. The sequence has a plurality of differing time periods between sequential packets. The packets may be accelerated orthogonally to the ion beam such that the ions of at least some of the packets are interspersed along a flight path. A signal may be generated in response to arrival of the ions at a detector, and the ions may be analyzed by recovering a spectrum from the signal using the sequence.

In another aspect, the invention provide a mass spectrometry system comprising an ion accumulator in an ion path from an ion source. Accumulation electrodes are disposed along the accumulator, and a driver is coupled to the acceleration electrodes for driving. packets of accumulated ions along a flight path according to a sequence of intervals. A detector disposed along the flight path from the acceleration electrodes generates a signal indicating overlapping arrival times of the ions from sequential packets. A processor is coupled to the detector for resolving a mass spectrum of the ions from the signal.

The accumulator will often accommodate, for example, first and second differing quantities of ions during differing first and second associated time intervals. The signal from the detector may vary with the differing quantities of ions from the accumulator, and the processor may resolve the mass spectrum by mathematically compensating for the differing quantities of ions using the first and second pulse periods. The signal from the detector may also vary with differing flight times of the ions (which may reflect differing masses of the ions), differing masses of the ions (which may impact detection probabilities at the detector), and the like. The mass spectrum may indicate the differing masses of the ions.

The processor may be configured to compensate for differing quantities of ions using an inverse matrix. The inverse matrix may be an inverse of a matrix corresponding to a simplex matrix of the sequence, with the values of the matrix modified in correlation with the accumulation intervals. Conveniently, the inverse of this matrix need not be taken repeatedly, as the same sequence may be used for many separate runs of the spectrometry system. Alternatively, the processor may be configured to resolve the spectrum using an inverse Hadamard transform.

The accumulator may comprise an accumulation region within a vacuum housing. The accumulation region may have a length extending along the ion beam, with the acceleration electrodes urging the packets of ions orthogonally relative to the accumulation region length so that the flight path is lateral relative to the ion path. A length of the detector may correspond with the length of the accumulation region. An ion reflector may be disposed along the flight path between the acceleration electrodes and the detector. First, second, and optionally more multi-pole rf-ion guides may be disposed along the ion path upstream of the accumulator, with the multi-pole rf-ion guides typically having differing pressures. A control module may be coupled to the first multi-pole rf-ion guide so as to effect filtering of the ions.

In yet another aspect, the invention provides a multiplexed orthogonal acceleration time-of-flight (TOF) mass spectrometer comprising a housing having an accumulation region disposed along an ion beam. A plurality of acceleration electrodes are disposed along the accumulation region. The acceleration electrodes are oriented to accelerate ions orthogonally relative to the beam so that the ions travel along an ion flight path. A driver coupled to the acceleration is configured to intermittently energize the acceleration electrodes according to a sequence of differing time periods so as to generate a series of ion packets having different quantities of ions. A detector is disposed along the flight path from the acceleration electrodes so that slower moving ions of any arbitrarily designated first packet arrive after faster moving ions of a second packet, the second packet being after the first packet in the series of packets. The detector generates a signal in response to the ions. A processor is coupled to the detector, the processor manipulating the signal according to differing time periods so as to compensate for the different quantities of ions.

In yet another aspect, the invention provides a method for characterizing a sample. An analyzer generates a signal in response to ions from the sample, and the analyzer modulates the ions according to a sequence of time intervals. The time intervals are integer multiples of a unit time. The method comprises separating each time unit of the sequence into an integer number of sampling time bins. The ions each have an associated sampling time bin. A plurality of sampling matrices are assembled, with the number of sampling matrices being the same as the integer number. For example, in the first sampling matrix, a signal value from an associated sample time bin of each unit is entered into the matrix, with the signal values preferably being entered from the first sampling bin of the first time unit of the sequence into the first matrix element location, the first sampling bin of the second time unit of the sequence into the second matrix element location, and so on. Each matrix is manipulated using an inverse of a matrix corresponding to the sequence. A mass spectrum can then be assembled from the manipulated matrices.

The mass spectrum may have intervals associated with the unit times, and may be assembled by entering a value from each matrix into each of the mass spectrum intervals. Optionally, the analyzer will be run repeatedly through the sequence with each sequence defining a scan of the analyzer. Hence, the mass spectrum may represent a plurality of scans, typically in a range from about 10 to about 50 scans. The signal for the individual scans may be summed, with the associated time bins of associated unit times being combined to a summed scan. This data may be pre-filtered, prior to spectrum recovery, using Gaussian smoothing or the like. The extraction time and other constant delays of the analyzer may be compensated for, and post filtering may be applied to the spectrum using a Fourier filter or the like.

DETAILED DESCRIPTION OF THE INVENTION

The present invention generally provides improved methods, devices, and systems for characterizing samples. In exemplary embodiments, the invention provides improved methods and systems for analyzing ions of an ion beam, most often a continuous ion beam such as that delivered by an electrospray ionization (ESI) source. Alternative embodiments may make use of differing ion sources, including pulsed ion source techniques. In many embodiments, an ion beam will be encoded by imposing a sequence of accumulation and pulse cycle periods, with the sequence preferably defining a maximum length pseudo-random sequence (MLPRS). Such accumulation and pulsing may be conveniently imposed by accelerating the ions in a direction lateral to an initial axis of the ion beam. This lateral acceleration is generally referred herein as an "orthogonal" axis arrangement, and the direction of acceleration will often be at 90° to the axis of the ion beam entering an accumulation region. Nonetheless, as the ions may carry some velocity component into the accumulation region, the flight path may be disposed at an angle other than 90° to the initial beam axis. In fact, it may also be possible to accelerate the ions laterally at some angle other than 90°, so that the term "orthogonal" as used to describe an "orthogonal axis TOF mass spectrometer" is not limited to systems in which the time-of-flight flight tube or acceleration pulses are disposed at exactly 90° relative to the initial beam axis.

Figure 1:
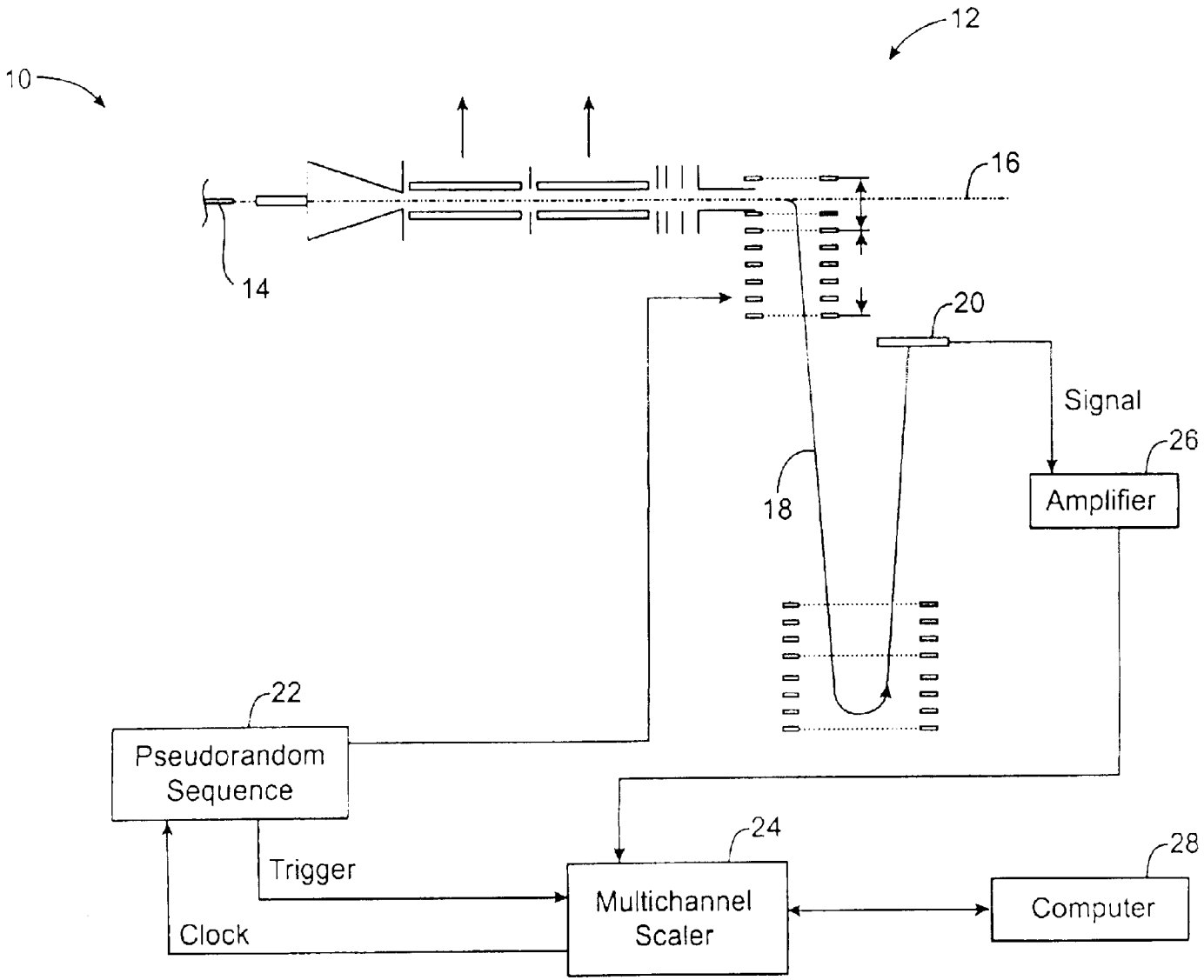
FIG. 1 schematically illustrates an orthogonal axis Hadamard transform time-of-flight mass spectrometer system according to the principles of the present invention.

Referring now to FIG. 1, a multiplexed orthogonal time-of-flight mass spectrometer 10 generally includes an analyzer 12 which receives an ion beam from an electrospray ionization (ESI) source 14. The ion beam is initially introduced into analyzer 12 along an axis 16, and analyzer 12 generally accumulates differing size packets of ions, with the quantity of ions in each packet varying with an accumulation time for that packet. Analyzer 12 accelerates or "extracts" the packets of ions laterally along a flight path 18. The extracted ion packets are closely spaced in time and along the flight path by different accumulation periods. Generally, a plurality of ion packets will be in the region between axis 16 and detector 20 at a given time. The velocities of the ions along flight path 18 vary with a mass-to-charge ratio (m/z) such that the ions of sequential packets, and often the ions of three or more packets, will arrive intermingled at a detector 20.

In addition to analyzer 12, system 10 includes a driver 22 to intermittently energize extraction electrodes of analyzer 12. Driver 22 modulates or encodes the beam with the MLPRS by reference to a clock signal supplied from a multi-channel scaler 24. Driver 22 also supplies a trigger signal to the multi-channel scaler 24 to signal the start of a sequence. An output signal from detector 20 is amplified by an amplifier 26 and is counted by multi-channel scaler 24.

The MLPRS applied by driver 22 will typically comprise time periods which may each be defined as integer multiples of a unit accumulation time. Operation of system 10 throughout one full MLPRS sequence is sometimes referred to as a "scan." To facilitate acquisition of the signal from detector 20 and identify a mass spectrum associated with one or more scans, multi-channel scaler 24 may count the amplified signal from amplifier 26 into time bins, which represent integral fractions of this unit time. Sequential scans may be summed, with the signal intensities of the first time bins of the first unit times being summed, the signal intensities of the second time bins of the first unit being summed, and so on. These counts can then be sent to a computer 28 for mathematical recovery of a particular mass spectrum and characterization of the sample material introduced into the system via ESI source 14. Computer 28 may also control a variety of additional components of system 10, with a wide variety of alternative data processing being possible. Computer 28 may include a variety of control modules, which may comprise hardware, software, firmware, and/or the like embodying machine readable instructions and data to effect the methods described herein. The structure and use of driver 22, multi-channel scaler 24, amplifier 26 and computer 28 are in many ways as similar to the corresponding figures shown in U.S. Pat. No. 6,300,626 issued to Brock et al. and entitled "Time-of-Flight Mass Spectrometer and Ion Analysis" on Oct. 9, 2001, the full disclosure of which is incorporated herein by reference.

Figure 2:
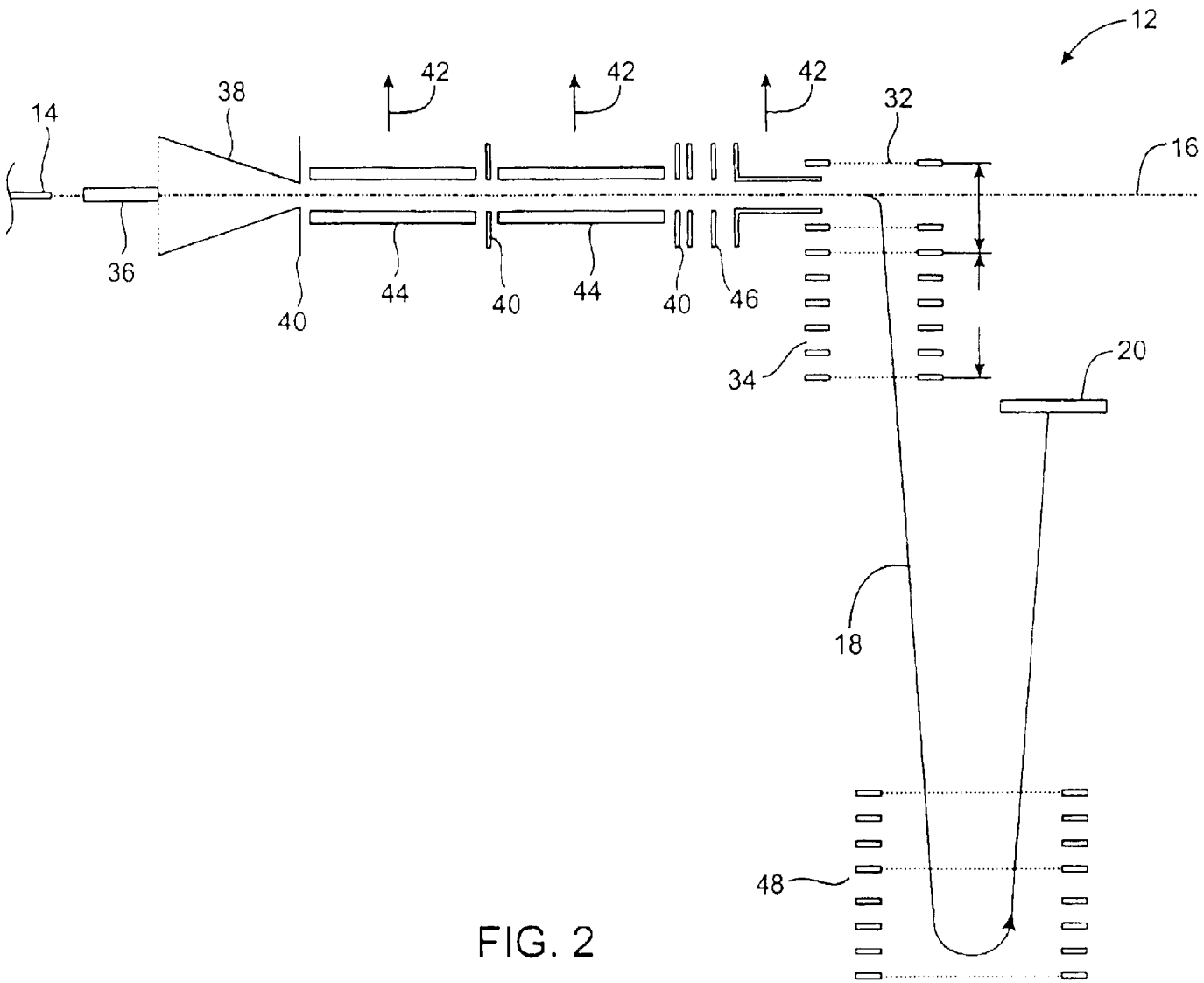
FIG. 2 schematically illustrates the analyzer of the mass spectrometer system of FIG. 1, and a method for its use.

Referring now to FIGS. 1 and 2, multiplexed orthogonal axis time-of-flight mass spectrometer analyzer 12 can impose a MLPRS on a continuous ion beam from ESI source 14 by accumulating ions from the source within an accumulation region 32, and by intermittently pulsing packets of the accumulated ions laterally with extraction/acceleration electrodes 34. As ions are accumulated (rather than simply turning off the beam and losing a portion of the ions to further analysis), a duty cycle of analyzer 12 may be greater than 50%, possibly being greater than 75%, in some cases being 90% or more, and possibly approaching 100%. Duty cycle may be defined for system 10 as the number of ions striking the detector from an extraction pulse divided by the total number of ions entering accumulator 32 during the corresponding accumulation period. Due to the ability to resolve the intermingled TOF spectra, analyzer 12 need not wait until the slowest ions from a previous extraction pulse strike the detector before releasing the next ion packet, providing high sensitivity along with the high mass resolution, low cost and complexity, and high dynamic range. As the ions of sequential pulses can be intermingled along flight path 18 and the signal from detector 20 subsequently deconvoluted with reference to the MLPRS imposed at extraction electrodes 34, the total flight time of the ion packets extracted in sequential pulses can overlap significantly, improving the instrument throughput.

The components of analyzer 12 may generally be broken into two groups: ion beam processing components disposed along axis 16 extending from ESI source 14, and flight tube components disposed along flight path 18. Droplets generated by an ESI spray tip of ESI source 14 may enter an inlet heated capillary 36 for desolvation. Throughout inlet capillary 36, droplet desolvation may produce intact molecular ions, which may then enter an electrodynamic ion funnel 38 which focuses the ions of the spray toward axis 16. Ion funnel 38 may have a structure such as that described in co-pending U.S. patent application Ser. No. 10/293,237, filed on Nov. 12, 2002, and entitled "Directing and Focusing of Charged Particles with Conductive Traces on a Pliable Substrate," or may comprise structures such as those described in U.S. Pat. No. 6,107,628. Both of these references are incorporated herein by reference. Funnel 38 generally enhances the quantities of ions which pass through aperture 40, possibly by as much as 10-fold over a skimmer arrangement of the same diameter as aperture 40. Tons traveling along the ion beam typically encounter a series of gradually reducing ambient pressures maintained by vacuum pumps, indicated schematically by arrows 42. The decreasing pressures along the ion beam and separation of the different pressure environments are facilitated by use of aperture 40 between each different pressure environment.

While some embodiments may avoid multi-pole RF-field ion guides or include only a single multi-pole RF-field ion guide along axis 16, exemplary analyzer 12 includes a plurality of multi-pole RF-field ion guides 44. RF-field ion guides 44 may comprise 6 or 8 pole structures, but will often comprise a quadrupole structure. The use of multiple RF-field ion guides in series (optionally being two RF-field ion guides, three RF-field ion guides, and more), along with the associated vacuum pumps 42 and apertures 40, facilitates providing a sufficient vacuum along flight path 18 when using an atmospheric pressure ESI source. A second RF-field ion guide 44 may be driven so as to filter ions above or below a particular mass-to-charge ratio, and/or to selectively pass or eliminate ions within a specific mass-to-charge range. Additionally, a third RF-field ion guide 44 (optionally being the downstream guide) may optionally be driven so as to cause collision-induced dissociation of the ions traveling along axis 16 under the direction of computer 28. The application of electrical potentials so as to make use of the ion guides for collision-induced dissociation and/or filtering need not be described here. Similarly, driving of multi-pole RF-field guides 44 so as to guide ions along axis 16 is likewise known. A steering lens 46 generally directs ions of the ion beam to travel along axis 16 as the ions enter the accumulation region 32. Such beam optics are again fairly conventional, particularly for use in known orthogonal axis time-of-flight mass spectrometers such as that described by M. Guilhaus in an article entitled, "*Orthogonal Acceleration Time-Of-Flight Mass Spectrometry at UNSW and Beyond.*"

Accumulation region 32 generally appears at the intersection of axis 16 from ESI source 14 and the flight path 18 for measuring time-of-flight of the pulses of ions. During accumulation, ions advance from steering lens 46 along axis 16. As can be understood with reference to FIGS. 4A an 4B, the quantity of accumulated ions (and hence, the number of ions in each pulse) will vary with an accumulation time. Accumulation times will typically comprise integer multiples of a unit time for the pseudo-random sequence, ideally being a MLPRS, with the exemplary accumulation periods varying, e.g., between 1 and 8 accumulation time units for an 8-bit MLPRS. After the appropriate accumulation time period for a given cycle in the pseudo-random sequence, extraction electrodes 34 are energized so as to extract the packets of accumulated ions along flight path 18.

Extraction/acceleration electrodes 34 will typically be configured to spatially focus the pulses of ions at a location along flight path 18, with the focus location depending in part on the combination of the extraction/acceleration electric fields a spacing between plates of the electrodes, and the like. Note that this spatial focusing may, but does not typically involve the convergence of the extracted ion beam in a direction perpendicular to the flight path 18, but rather compression of the extracted ion packets along the flight path 18. Spatial focusing takes place due to finite lateral dimensions of the continuous ion beam entering the accumulation region along axis 16. After being accumulated in a field-free region, the ions will experience a pulse driving force (i.e., an extraction field) in the direction along the flight path 18, so that ions positioned farther away from the acceleration electrodes will experience greater acceleration than ions initially positioned closer to the acceleration electrodes. Under this differing extraction field, spatial focusing of the extracted ion packets along flight path 18 can result.

The ions traveling along flight path 18 will preferably be focused at detector 20, so that the detector may simply be positioned at the first focal plane of ion packets from extraction/acceleration electrodes 34. However, it is often beneficial to provide a longer flight path for increased mass resolution, and it is also beneficial to minimize the residual pressure of the flight tube. An introduction of an ion reflector 48 will significantly increase the ion flight path and will allow adjusting the position of the focal plane 2 of the reflected ion packets. The first focal plane can then be treated as a pseudo-ion source, for e.g., a single-stage reflector, whose second focal plane may be adjusted based on the acceleration/reflection voltages, reflector length and a distance from the first focal plane to the entrance to the reflector. Ion reflector 48 will often redirect flight path 18 toward detector 20 with the combination of the accelerating electrodes 34, reflector 48, and optionally other ion optics being used to bring the ions to a space-time focus on the detector surface. Hence, flight path 18 may be unreflected, may include a single-stage reflection, may include a multi-stage reflectron, or may include multiple reflection stages.

By accumulating ions in extraction region 32, analyzer 12 allows high duty cycles, with few ions being lost as a result of the multiplexing process. To provide such duty cycles, ion extraction may be performed in a period that is shorter than the flight time of the fastest ions (i.e., those having the lowest m/z) across the accumulation region 32 (which also serves as the extraction region for acceleration electrodes 34) along axis 16. Hence, the majority of ions may be accumulated in the accumulation region over the maximum accumulation cycle. As an example, the ions may be accumulated in the accumulation region 32 over the longest full cycle or multiple-bit periods (including both 1's and 0's) of a MLPRS sequence. For an 8-bit MPRS sequence, modulation frequency between two consecutive ion extractions (f) may be calculated as follows:

$$f = \frac{L_{ext}}{\sqrt{\frac{z_1 e U_0}{m_1}}} N_0$$

$L_{ext}$ being the length of the extraction or accumulation region 32, $m_1/z_1$ being the lowest mass-to-charge ratio of the ions of interest, $U_0$ being the acceleration potential along axis 16, which corresponds to the initial kinetic energy of ions entering the accumulation region. $N_0$ is the one plus the maximum of number of consecutive 0's together in the MLPRS. Applying reasonable numbers as an example, at m/z equal to 500 Da (applicable to, for example, peptide and protein analysis), $U_0$ may be equal to 1 volt V, $L_{ext}$ is equal to 3 cm, and $N_0$ is equal to 5, the modulation frequency f is 180 kHz. The average frequency of the driver for extraction electrode 34 is f/3 or about 60 kHz. Given a pulsed extraction voltage of about 400 volts followed by 4,000 volts static acceleration potential, and with a pusher grid capacitance of 200 pF, this frequency range is readily available with existing fast-switching electronics.

The time required to extract heaviest m/z from the accumulation region 32 can be estimated as follows:

$$t_{extract} = \frac{2x}{\sqrt{\frac{2 z_h e U_{ext} x}{m_h d_{ext}}}}$$

where x is the coordinate of the heaviest ions along axis 18 in the accumulation (or extraction) region, $m_h/z_h$ is the mass to charge ratio of the heaviest ions in the spectrum, $U_{ext}$ is the pulsed extraction voltage, and $d_{ext}$ equal to 400 V, $m_h/z_h$ equal to 4000 Da, $d_{ext}$ equal to 30 mm, one would estimate $t_{extract}$ as 3–4 $\mu$s. The estimate $t_{extract}$ time will reduce the analyzer duty cycle, as ions from the continuous beam should not be introduced into the accumulation region prior to extraction of all m/z ions form the previous pulse. As the number of consecutive "0" and "1" in a MLPRS sequence varies, the extraction pulse time effect on duty cycle changes from one extraction pulse to another. For example, for a 5-bit MLPRS sequence with a modulation period, $t_{modulation}$, of 5.6 $\mu$s (corresponding to a modulation rate of 180 kHz) the duty cycle for ions extracted after accumulation for N modulation bins may be as follows:

$$\text{duty_cycle}_{N_bit} = \frac{N t_{modulation} - t_{extract}}{N t_{modulation}}$$

Therefore, in our example, the duty cycle for ions accumulated for a single modulation bin (i.e., N=1) may be ~40%, while ions accumulated for 5 consecutive modulation bins (N=5) may be acquired at a duty cycle of ~88%.

As accumulation of a new packet of ions (or the next accumulation period), may not effectively begin in the accumulation region until the previous packet of ions has cleared the accumulation region and the acceleration voltage on the extraction electrodes returns to a value appropriate to promote the drift of ions along the ion beam axis. Hence, one accumulation time unit of the MLPRS will typically not be less than the extraction time. Typical extraction times may range from 2–4 $\mu$s, and this extraction time may detract from the following accumulation. This can be compensated for mathematically by appropriately biasing the waited simplex matrix prior to computing the matrix inverse. Hence, the overall duty cycle of analyzer 12 can be between 40% and 90%, typically being between about 50% and 80%.

The length of the extraction region along axis 16 and acceleration voltages should be appropriately chosen to accommodate both the longest and shortest intended accumulation periods, along with the desired m/z range. Orthogonal extraction decouples mass resolution from the temporal and kinetic energy distributions of ions along the ion beam axis 16 during a particular pulse from the MLPRS modulation frequency, analyzer may also 12 avoid limitations of on-axis modulation systems, including the dependence of their mass resolution on modulation frequency.

Temporal ion spread may of analyzer 12 may be largely determined by the rise time of the extraction pulse, providing a highly advantageous focusing of the kinetic energy spread in ion reflector 48. Given, for example, an ion extraction pulse rise time of 5 ns, a resolution of 22,000 is achievable for a m/z equal to 4,000. This resolution may be higher at longer flight times after the extraction, and may be determined by the velocity of the ions entering the extraction region.

Multiplex signal-to-noise ration (SNR) gain of analyzer 12 may be proportional to the number of ion packets which can be accommodated along night path 18 at a particular time. More generally, the analyzer 12 of FIG. 2 may provide a signal-to-noise ration (SNR) improvement for non-periodic noise and disperse spectra of about SQRT (N)/2 for simplex modulation, where N is the sequence length of the MLPRS employed. For an analyzer having the configuration shown in FIG. 2, with a 2 meter flight path and a m/z range of 500–4,000 an acceleration voltage of 3,000 V, a sequence modulation frequency of 180 kHz and an average pusher frequency of 60 kHz, the multiplex gain may be about 4 over conventional OA-TOF systems. The dynamic range of analyzer 12 will be determinative of the dynamic range of the detector, which may be a conventional detector such as a chevron assembly of micro-channel plates (MCP).

The dynamic range may be improved using improved detectors, such as a MCP-photo-multiplexer assembly. Since accurately detecting the ions of each packet is helpful in minimizing mathematical noise that can be generated by the inverse transform used to recover the mass spectrum, improvements in dynamic range and response time of the MCP detector are beneficial. New detector types can be advantageously employed to facilitate increased accuracy and dynamic range. In some embodiments, these systems employ a single MCP plate (instead of several plates aligned together in a chevron configuration) followed by a scintillator and photomultiplier. These so-called "bipolar" detectors also advantageously offer dielectric isolation of the acquisition system from the high voltages employed in the detector. Further expansion of the dynamic range may be achieved using technology described by M. E. Belov, et al. in an article published in *Anal. Chem.,* 2001, Vo. 73, pp. 5052–5060.

Figure 3:
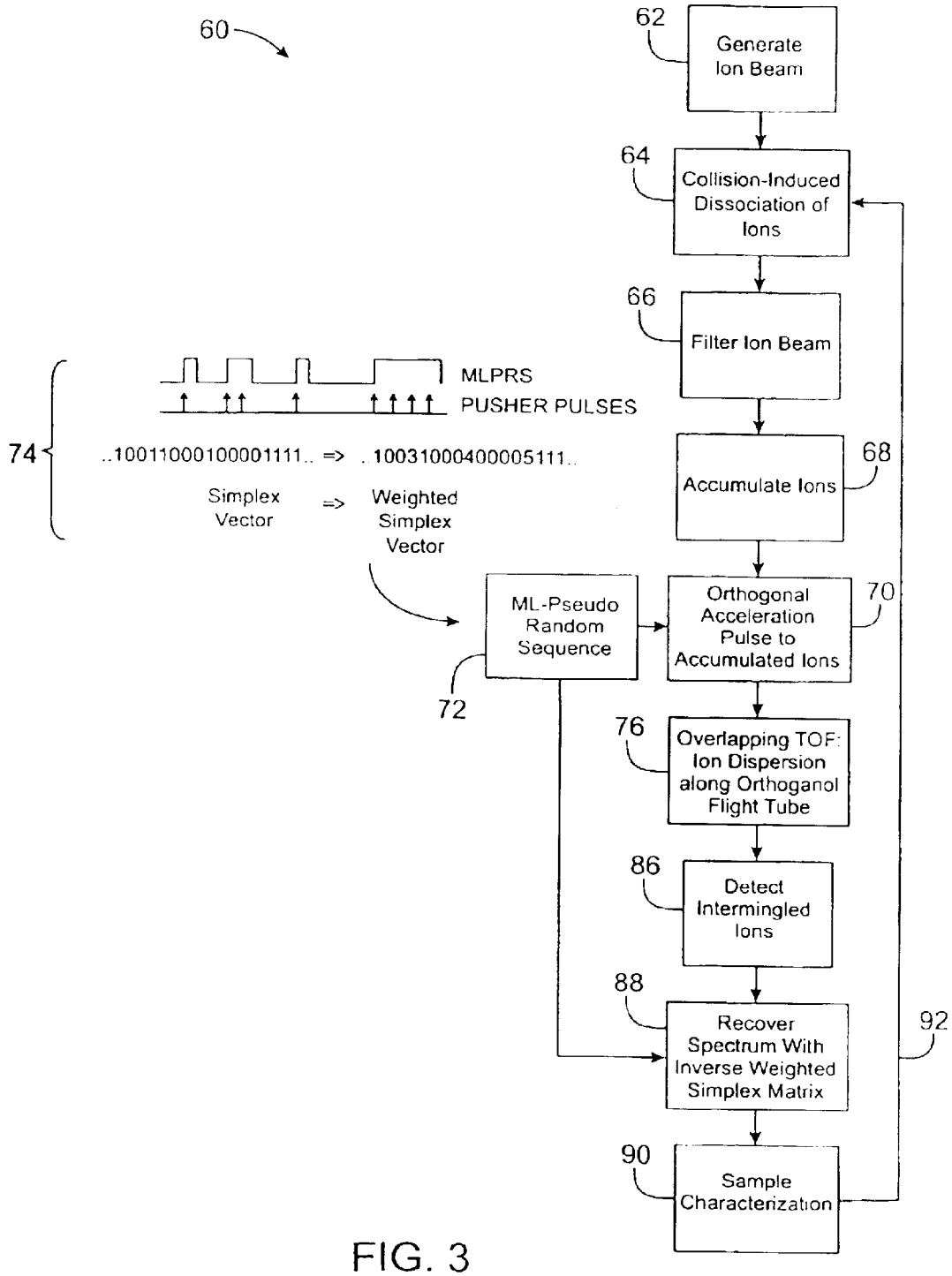
FIG. 3 is a flowchart graphically illustrating a mass spectrometer analysis method using the system of FIG. 1.

Referring now to FIG. 3, the steps which may be included in an analysis method 60 are illustrated in flowchart form. An ion beam 62 is generated using an ESI. The electrospray ions may be passed through a heated capillary tube, ion funnel, and the like as described above, and collision-induced dissociation of the ions 65 may be effected using a multi-pole RF-field ion guide. Similarly, selective data-dependent high-pass, low-pass, or hand-pass filtering of the ions 66 may also be effected by a multi-pole rf-field ion guide. Dissociation and filtering of the ion beam may be directed by a computer.

Figure 4A:
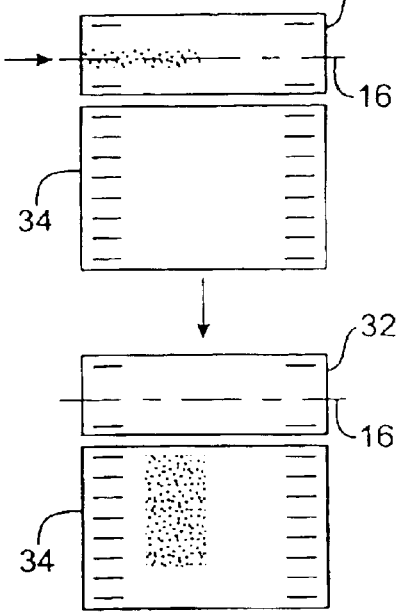
FIGS. 4A and 4B graphically illustrate accumulation and pulsed acceleration of differing quantities of ions resulting from differing accumulation time periods.
Figure 4B:
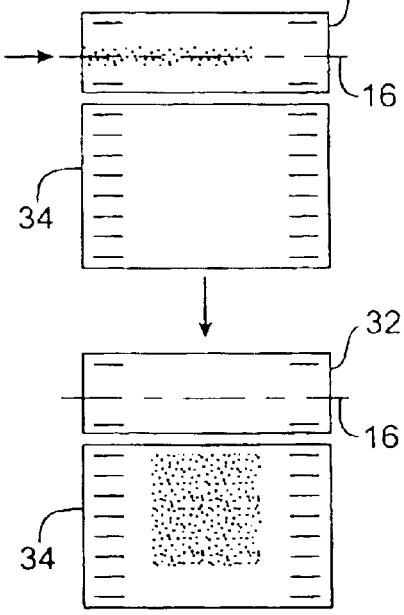

Ions are accumulated 68 and accelerated orthogonally 70 to the trajectory of the incoming continuous ion beam according to a pseudo-random sequence 72. A timing diagram 74 for a MLPRS 72 is also included in FIG. 3. The accumulation periods vary depending on the MLPRS sequence. The voltage applied to extraction electrodes 34 so as to extract the ions from accumulation region 32 (see FIG. 2) are implemented as brief pulses. The resulting different quantities of ions in sequential packets are schematically illustrated in FIGS. 4A and 4B. The MLPRS sequence is here illustrated as a sequence of elements, either 1's or 0's, which can be logically chosen to have differing periods which vary in such a way as to facilitate the mathematical recovery of the spectrum based on well-established rules for generation of a simplex matrix. Exemplary MLPRS and methods for generating these sequences are described, for example, in an article entitled "*Hadamard Transform Optics*" by M. D. Hardwit et al., in *Academic Press*, Long 1979; and in "*Fourier Transforms in NMR, Optical and Mass Spectrometry*" by A. G. Marshal et al., in *Elsevier*, Amsterdam, 1990.

Figure 5A:
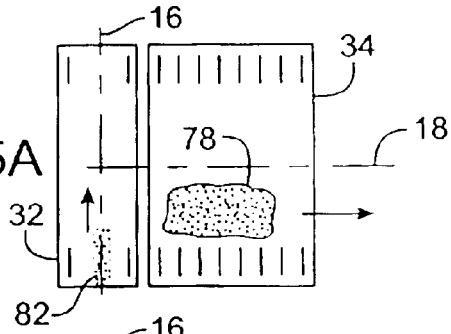
FIGS. 5A–5C schematically illustrate intermingling of sequential pulses of ions along the flight tube in the mass spectrometer system of FIG. 1.
Figure 5B:
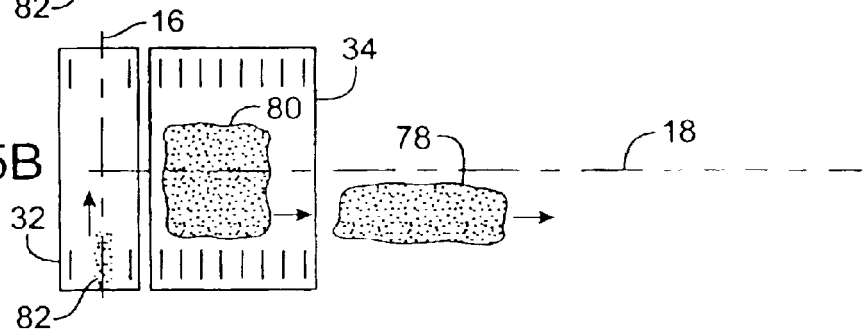
Figure 5C:
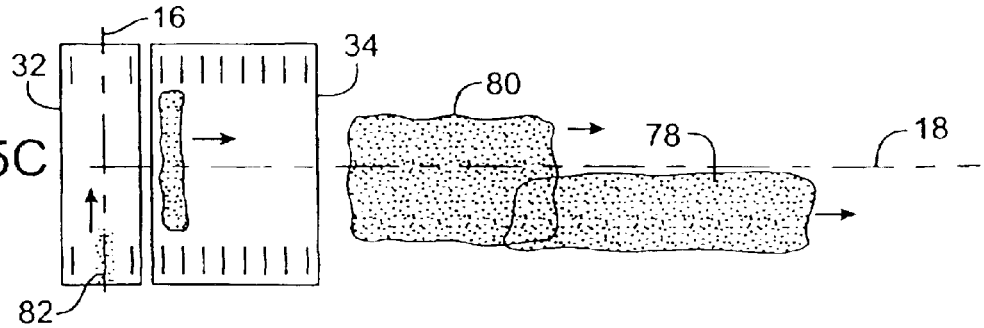

Referring now to FIGS. 3 and 5A–5C, the packets of ions advance along flight path 18 with a frequency that is sufficiently high as to result in significant intermingling 76 or at least partial overlap of the ions of sequential packets. The extraction pulses are synchronized with each "1" bin in the MLPRS, and the unit modulation period (i.e., the time width of a single bin in the MLPRS) may depend on the flight time of the fastest ions across the accumulation region and the order of the MLPRS. As illustrated in FIG. 5A, a first packet 78 extracted from accumulation region 32 travels along flight path 18, with the ions undergoing axial dispersion along the flight path. At a time subsequent to that shown in FIG. 5A, as illustrated in FIG. 5B, a subsequent packet of ions 80 has been accumulated from ion beam 82, and is also progressing along flight path 18 while also undergoing dispersion along the flight path. At a still further subsequent time as illustrated in FIG. 5C, as the two sequential packets of ions travel along flight path 18, the faster moving ions of the subsequent packet 80 overtake the slower moving ions of initial pulse 78 prior to arriving at the detector.

Referring once again to FIGS. 3 and 2, the intermingled ions are detected at detector 20, and the resulting signal is mathematically recovered with reference to the MLPRS. Unlike an inverse Hadamard transform resolution of an ion beam modulated with an "on/off" modulator, the quantities of ions in the different packets will often vary with the accumulation period for that particular packet. When a simple "on/off" modulator is applied, the pseudo-random sequence and associated Hadamard transform may directly include only 1's and 0's. For example, the pseudo-random sequence may comprise:

1 1 1 1 0 0 0 1 0 0 1 1 0 1 0 . . .

However, as the quantities of ions transmitted at a particular packet will vary with the accumulation cycle (or the time since the last pulse), the encoded intermingled ions may alternatively be modeled using a pseudo-random sequence having the following form, in which the first non-zero element of each cycle identifies the length of the preceding cycle (and hence the quantity of accumulated ions being sent in the associated packet):

1 1 1 1 0 0 0 4 0 0 3 1 0 2 0 . . .

The corresponding simplex matrix for the standard "on/off" pseudo-random sequence will generally take the form:

$$S = \begin{array}{c} a_1 \\ \downarrow \\ \begin{bmatrix} 1&0&1&0&1&1&0&0&1&0&0&0&1&1&1 \\ 1&1&0&1&0&1&1&0&0&1&0&0&0&1&1 \\ 1&1&1&0&1&0&1&1&0&0&1&0&0&0&1 \\ 1&1&1&1&0&1&0&1&1&0&0&1&0&0& \\ 0&1&1&1&1&0&1&0&1&1&0&0&1&0&0 \\ 0&0&1&1&1&1&0&1&0&1&1&0&0&1&0 \\ 0&0&0&1&1&1&1&0&1&0&1&1&0&0&1 \\ 1&0&0&0&1&1&1&1&0&1&0&1&1&0&0 \\ 0&1&0&0&0&1&1&1&1&0&1&0&1&1&0 \\ 0&0&1&0&0&0&1&1&1&1&0&1&0&1&1 \\ 1&0&0&1&0&0&0&1&1&1&1&0&1&0&1 \\ 1&1&0&0&1&0&0&0&1&1&1&1&0&1&0 \\ 0&1&1&0&0&1&0&0&0&1&1&1&1&0&1 \\ 1&0&1&1&0&0&1&0&0&0&1&1&1&1&0 \\ 0&1&0&1&1&0&0&1&0&0&0&1&1&1&1 \end{bmatrix} \end{array}$$

$$S = \begin{array}{c} a_i \\ \downarrow \\ \begin{bmatrix} 1&0&2&0&1&3&0&0&4&0&0&0&1&1&1 \\ 1&1&0&2&0&1&3&0&0&4&0&0&0&1&1 \\ 1&1&1&0&2&0&1&3&0&0&4&0&0&1&1 \\ 1&1&1&1&0&2&0&1&3&0&0&4&0&0&0 \\ 0&1&1&1&1&0&2&0&1&3&0&0&4&0&0 \\ 0&0&1&1&1&1&0&2&0&1&3&0&0&4&0 \\ 0&0&0&1&1&1&1&0&2&0&1&3&0&0&4 \\ 4&0&0&0&1&1&1&1&0&2&0&1&3&0&0 \\ 0&4&0&0&0&1&1&1&1&0&2&0&1&3&0 \\ 0&0&4&0&0&0&1&1&1&1&0&2&0&1&3 \\ 3&0&0&4&0&0&0&1&1&1&1&0&2&0&1 \\ 1&3&0&0&4&0&0&0&1&1&1&1&0&2&0 \\ 0&1&3&0&0&4&0&0&0&1&1&1&1&0&2 \\ 2&0&1&3&0&0&4&0&0&0&1&1&1&1&0 \\ 0&2&0&1&3&0&0&4&0&0&0&1&1&1&1 \end{bmatrix} \end{array}$$

Correlation matrix S may be formed by using the binary sequence as the first column of the matrix and filling in the subsequent columns with the remaining portions of the sequence in order. The output signal Z of the detector may be then given by:

$$Z = S \times F + U$$

in which a mass spectrum vector F of the ion being is added to a background signal U. The inverse transform $S^{-1}$ is then given by the following equation:

$$S^{-1} = \frac{2}{(N+1)} \begin{bmatrix} + & + & + & + & - & - & - & + & - & - & + & + & - & + & - \\ - & + & + & + & + & - & - & - & + & - & - & + & + & - & + \\ + & - & + & + & + & + & - & - & - & + & - & - & + & + & - \\ - & + & - & + & + & + & + & - & - & - & + & - & - & + & + \\ + & + & - & + & - & + & + & + & + & - & - & - & + & - & - \\ - & + & + & - & + & - & + & + & + & + & - & - & - & + & - \\ - & - & + & + & - & + & - & + & + & + & + & - & - & - & + \\ + & - & - & + & + & - & + & - & + & + & + & + & - & - & - \\ - & + & - & - & + & + & - & + & - & + & + & + & + & - & - \\ - & - & + & - & - & + & + & - & + & - & + & + & + & + & - \\ - & - & - & + & - & - & + & + & - & + & - & + & + & + & + \\ + & - & - & - & + & - & - & + & + & - & + & - & + & + & + \\ + & + & - & - & - & + & - & - & + & + & - & + & - & + & + \\ + & + & + & - & - & - & + & - & - & + & + & - & + & - & + \end{bmatrix}$$

which may be calculated by replacing each "0" in S by −1/k (where k is the number of 1's throughout the pseudo-random sequence) and each "1" by 1/k. This allows the mass spectrum vector F to be calculated by:

$$F = S^{-1} \times Z$$

When compensating for different quantities of ions in the different packets, the same general form of this mathematics remains applicable. However, each initial "1" at the beginning of a cycle is replaced by a number representing the accumulation period units (as described above). Hence, the transform matrix will be modified to the following form:

For a third order MLPRS (N=3) having a sequence length of 7, the simplex modulation vector is:

0 0 1 0 1 1 1

This vector is modified in form the weighted simplex vector by accounting for accumulation over the "0's" as follows:

0.0 0.00 3.00 0.00 2.00 1.00 1.00

An example of a weighted simplex vector adjusted with final weightings so as to account for extraction times, etc. may be:

0.0 0.00 2.32 0.00 1.32 0.32 0.32

The resulting weighted simplex matrix may then be assembled:

| | | | | | | |
|---|---|---|---|---|---|---|
| 0.00 | 0.00 | 2.32 | 0.00 | 1.32 | 0.32 | 0.32 |
| 0.00 | 2.32 | 0.00 | 1.32 | 0.32 | 0.32 | 0.00 |
| 2.32 | 0.00 | 1.32 | 0.32 | 0.32 | 0.00 | 0.00 |
| 0.00 | 1.32 | 0.32 | 0.32 | 0.00 | 0.00 | 2.32 |
| 1.32 | 0.32 | 0.32 | 0.00 | 0.00 | 2.32 | 0.00 |
| 0.32 | 0.32 | 0.00 | 0.00 | 2.32 | 0.00 | 1.32 |
| 0.32 | 0.00 | 0.00 | 2.32 | 0.00 | 1.32 | 0.32 |

Using a general matrix inverse solution, the Inverse of the Weighted Simplex Matrix is then:

| | | | | | | |
|---|---|---|---|---|---|---|
| −0.23 | −0.01 | 0.39 | −0.01 | 0.06 | 0.08 | −0.04 |
| −0.01 | 0.39 | −0.01 | 0.06 | 0.08 | −0.04 | −0.23 |
| 0.39 | −0.01 | 0.06 | 0.08 | −0.04 | −0.23 | −0.01 |
| −0.01 | 0.06 | 0.08 | −0.04 | −0.23 | −0.01 | 0.39 |
| 0.06 | 0.08 | −0.04 | −0.23 | −0.01 | 0.39 | −0.01 |
| 0.08 | −0.04 | −0.23 | −0.01 | 0.39 | −0.01 | 0.06 |
| −0.04 | −0.23 | −0.01 | 0.39 | −0.01 | 0.06 | 0.08 |

Similar matrices can be derived for different order sequences or vectors. Based on the recovered signal for a particular spectrum, the sample may be characterized 90 using conventional TOF mass spectrometry techniques.

A variety of refinements may be incorporated in analysis method 60. For example, when a recovered spectra for a scan (or multiple scans) may appear ambiguous during real-time or subsequent sample characterization.

Alternatively, analysis of a recovered spectrum may benefit from subsequent sample characterization, for example, to elucidate sequence information of a set of particular species. Advantageously, during one or more subsequent scans the degree or character of collision-induced dissociation 64 may be changed using a feedback loop 92. Alternatively, when ions beyond the m/z range of interest are masking the signal for ions of interest, feedback look 92 may similarly alter filtering of the ion beam 66.

Figure 3A:
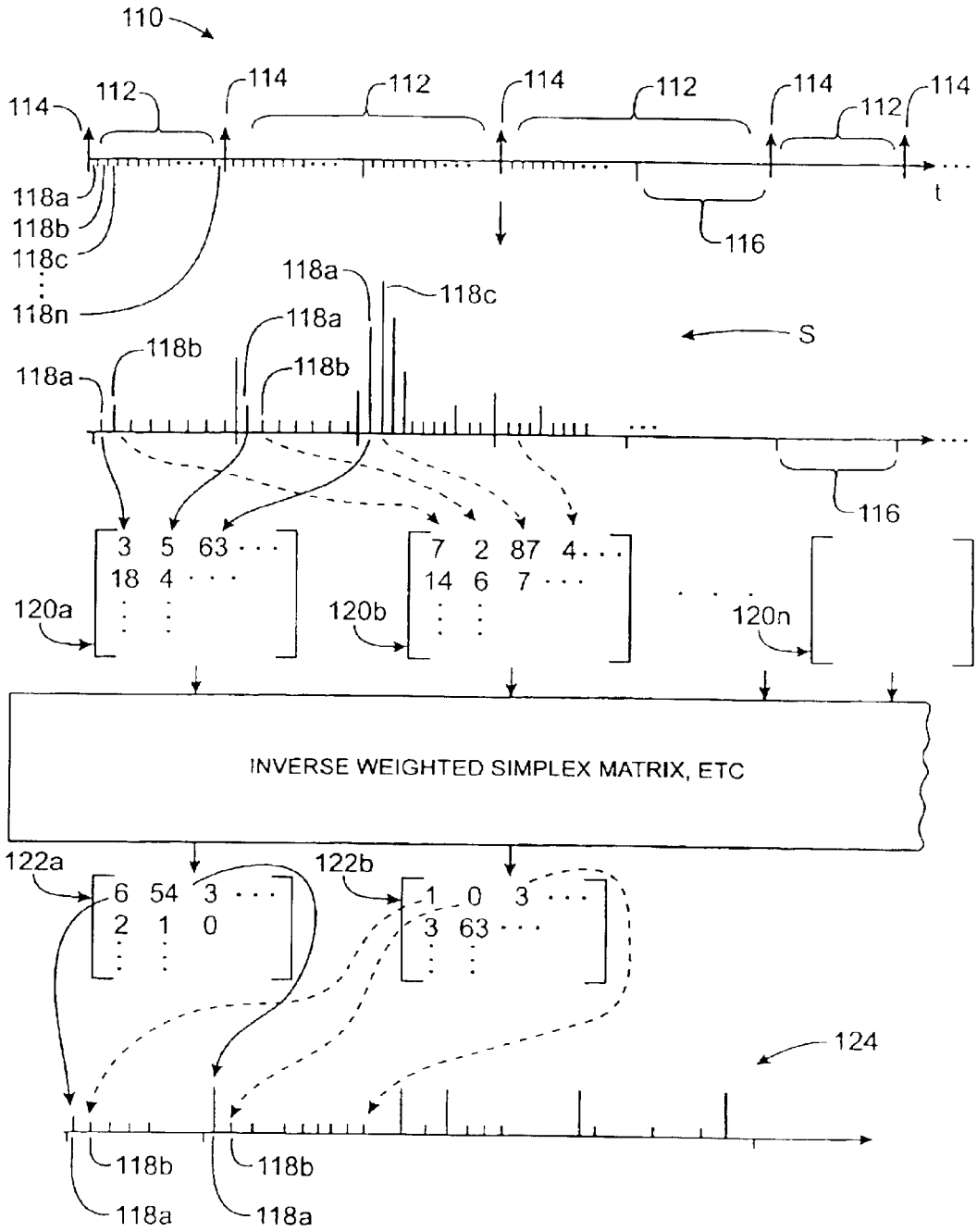
FIG. 3A schematically illustrates a method for manipulating an intermingled ion signal using a matrix based on the pulse sequence so as to resolve a spectrum.

Referring now to FIG. 3A, a sequence 110 defines a series of accumulation periods or intervals 112 along a time line t. A series of discreet extraction pulses 114 separate the accumulation periods, with the accumulation periods defining integer multiples of a unit accumulation period 116. As noted above, this is a simplification, as the extraction pulses will consume some portion of the overall sequence time.

Each time unit 116 of sequence 110 is separated into an integer multiple times a unit time bin 118, so that each time unit 116 includes a first bin 118*a,* a second bin 118*b,* . . . and an nth bin 118*n.*

A signal S from the detector is generally broken up into time units 116 and the constituent time bins 118 correlating with sequence 110. Sampling matrices 120*a,* 120*b,* . . . , 120*n* may be assembled from signal S by inserting the signal value of the first time bin 118*a* for each unit time 116 into a first sampling matrix 120*a,* the second value of a second bin 118*b* from each unit time into a second sampling matrix 120*b,* and so on. These matrices may then be manipulated by applying the inverse weighted simplex matrix as described above. The resulting manipulated matrices 122*a,* 122*b,* . . . , may be then be used to reassemble spectrum 124 by taking the sequential matrix elements from the first manipulated matrix 122*a* and inserting them into associated first time bins 118*a,* and taking the elements from a second manipulated matrix 122*b* and introducing them into the second time bins, and so on. The resulting spectrum vector may be used for characterizing the sample.

Additional refinements may improve the quality of the characterization. As noted above, it may be beneficial to compensate for the extraction time and other constant delays in the weighted simplex matrix, and the signal S or TOF vector may be filtered using a Gaussian filter or the like. Post filtering of the mass spectrum vector 122 using a Fourier filter or the like may also be beneficial. Some rotation of the sampling matrices 120 may also be employed so as to provide a meaningful mass spectrum vector. The modulation process, acquisition of the signal in to the time bins, and recovery of the spectrum may be understood with reference to the following exemplary method steps, which can be interpreted by reference to the C+ or C++ computer languages:

HT_OTOF Modulation/Acquisition/Spectrum Recovery Process "Pseudo Code":

Modulation Process (performed in the extraction/accumulation region with appropriate timing control:

```
for(scan_count = 0; scan_count < #scans_to_average; scan_count++){
  for(sequence_bit_count = 0; sequence_bit_count < sequence_length;
  sequence_bit_count++){
    if(sequence_bit_count == 1) push_the_ions_
    out_of_the_extraction_region;
    else accumulate_ions_in_the_extraction_region;
  }
}
```

-continued

Acquisition Process (performed by acquisition system - the detector and acquisition PCI card):

```
for(scan_count = 0; scan_count < #scans_to_average; scan_count++) {
  for(sequence_bit_count = 0; sequence_bit_count < sequence_length;
  sequence_bit_count++){
    detect_ions_at_the_detector and record into
    the appropriate bin of the
        Time Of Flight vector; /* TOF vector
      length=sequence_length*acquisition_speed */
  }
  SUM_OF_SCANS = SUM_OF_SCANS+this_SCAN;
}
transmit SUM_OF_SCANS to the host PC;
```

Spectrum Recovery Process (performed in the host PC):

```
for this SUM_OF_SCANS do{
  build Simplex Matrix from LFSR generated sequence;
  weight the Simplex Matrix according to accumulation pattern;
  compensate for extraction time and other constant delays in the
  Weighted Simplex Matrix;
  compute inverse of the Weighted Simplex Matrix;
  /* this need only be done once */
  perform any filtering on the Time-of-Flight (TOF) Vector;
  for(x=0;x<samples_per_sequence_bit;x++) {
    extract every ith element from the TOF_Vector;
    apply the Inverse Weighted Simplex Matrix;
    write back every ith element into the Mass Spectrum Vector;
  }
  perform any post filtering on the Mass Spectrum Vector;
}
```

Additional flexibility in designating the sequence can also be provided. For example, while many embodiments make use of packets having differing accumulation periods (and associated differing quantities of ions), alternative embodiments may have uniform accumulation periods for some or all of the different packets, so that adjustment for differing ion quantities can be avoided. Added flexibility in designating specific accumulation periods may, for example, help overcome physical limitations of the instrument associated with the shorter accumulation periods of the sequence, such as fringing fields, excessive extraction times, and the like. Fringing fields may delay extraction, as it is beneficial to wait for the ions to clear such fields before extraction commences. The delays associated with such fringing fields, together with a long extraction time, may even exceed the duration of the shortest accumulation period of the desired modulation frequency for a particular system.

As noted above, a plurality of scans will often be summed together so as to avoid statistical variations and the like. For a simplex sequence or vector as follows:

00001001010011111000110111010 1, the weighted simplex sequence or vector is:

0000500302003111100041021102 02.

The total of value of this weighted sequence is 31, as can be determined by summing the values of each element of the sequence. When (for example) three scans based on such a sequence are to be summed together, the resulting summed values are simply three times each individual scan. The associated summed detection signals may be manipulated as described above. Alternatively, a different set of scans may be summed together and generate a substantially equivalent summed signal. For example, comparing our repeated three scan summation to an equivalent 5 scan summation:

```
0000500302100311110004102110202          = 31
0000500302100311110004102110202
0000500302100311110004102110202          ×3
0000, 15, 0090630093333000, 12, 306330606  = 93
```

Take a linear combination of 5 vectors with exactly the same extraction times, and whose total accumulation total is identical and where no accumulation period is less than 3

```
0000300300300030000003003000300
0000300003000300300003000300003
0000300300000003000003000030000
0000300003000300030000300000300
0000300300000300000003003000003
0000, 15, 0090630093333000, 12, 306330606  = 93
```

Hence, effects of the extraction and drift time can be minimized by avoiding the shortest accumulation times, which may improve efficiency. While 5 differing sequential scans are employed to provide a theoretical summation of a single sequence repeated three times, the same manipulation of the resulting summed signal remains valid. Advantageously, a single "scan" can be built from a linear combination of scans whose accumulation periods are constant (or have other desired properties), but when summed, provide equivalent relative accumulation weighting of the original weighted Simplex Vector.

From the above, it will be understood that a scan need not be treated as a standalone entity from which the original spectrum need be obtained via mathematical manipulation. Instead, a number of sequences or "sub-scans" can be summed together in order to create a valid scan vector from an inverse mathematical perspective (typically using the inverse weighted simplex matrix). This summing of the signal for multiple scans can provide additional design flexibility. For example, it is possible to build a linear combination of sub-scans where all of the pushes accumulate for exactly the same time, although it might be less efficient that other combinations. Other scan combinations may also be provided, as desired for a particular instrument design. This different scan summation mode may be described as a "Linear Combination" mode, and allows sub-scan ion signals to be summed and to resolve the associated spectrum using a different modeled or "standard" sequence.

Note that the number of summed scans may differ from the mathematical multiplier applied to the weighted simplex sequence, as in the above example using five scans to achieve the equivalent of three. The number of packets or pulses may also differ between the summed scans and the sequence on which it is based, for example using 31 pulses in the 5 scans, as opposed to 33 (or 45) in 3 scans in the "standard" mode. In other embodiments, assuming a unit time of 8 microseconds, we might accumulate for 24 us (3 bit periods) in 24 of them, and for 16 us in 7 of them. Furthermore, it is also possible to add one bit period, or 8 us, to account for extract and fringe field clearance times for each packet pushed.

When summing different scans in the Linear Combination mode, the pushes or pulses in any sub scan should occur at the same time in the sequence as an associated pulse in the weighted simplex matrix or other sequence being modeled. Additionally, the relative accumulation weighting, once the sub-scans are summed, should be an integer multiple of the original weighted simplex matrix or other modeled sequence. If these steps are taken, the inversion mathematics can properly recover the spectrum.

Figure 6:
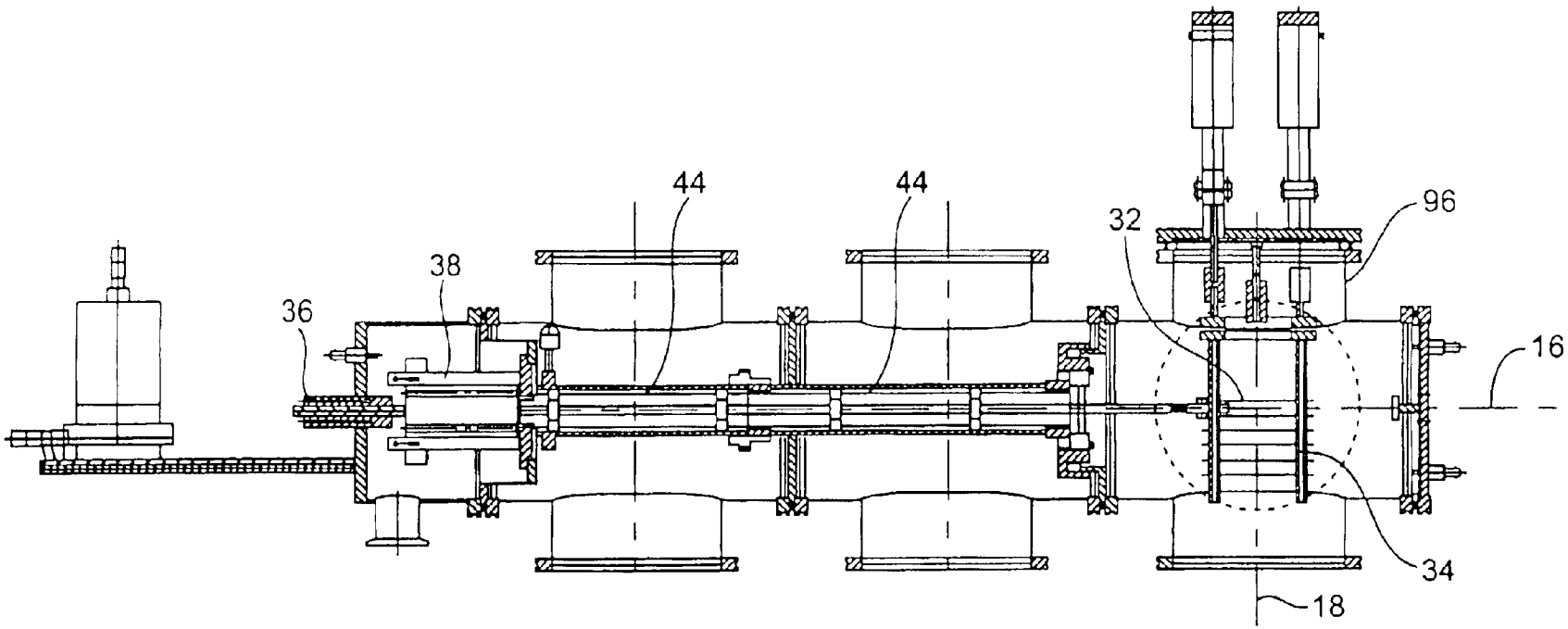
FIG. 6 is a cross-sectional view of a portion of an analyzer similar to that of FIG. 2.

Referring now to FIG. 6, a more detailed illustration, in cross-section, of many of the components of analyzer 12 is provided. A housing 96 surrounds much or all of the ion beam axis 16 and flight path 18, allowing pressures of (for example) 5 times $10^{-8}$ torr in accumulation region 32, sequential ion guide pressures of $10^{-5}$ torr and 5 times $10^{-3}$ torr, and a pressure in funnel 38 of about 1 torr. Such pressures may be readily provided using off-the-shelf components including sequential stages of vacuum pumps, interstage orifice structures, and the like. Conveniently, many of these components may be used directly from existing orthogonal axis time-of-flight mass spectrometer systems.

When modifying such systems for use according to the present invention, the driver coupled to acceleration electrodes 34 can be modified to incorporate the pseudo-random sequence described above. The pulse frequency varies according to the pseudo-random sequence. As the focal length of the acceleration electrode varies with the extraction/acceleration electrical fields, the location of the detector along the flight path can be modified. Additional ion source communication capabilities may also be included in the computer of the mass spectrometer system, enhancing the interactions, for example, a capillary separation and the mass spec operating parameters. Such enhanced communication may be coded using existing component object model (COM) languages, and is well within the capabilities of readily available mass spec controllers.

Preferably, the pseudo-random sequence will have an order of between about 2 and 13, typically having an order of between 3 and 10, and ideally having an order of about 5. The order of a MLPRS is generally related to the overall length of the sequence, as well as the length of the Linear Feedback Shift Register (LFSR) often used to generate the sequences, with a fifth order sequence typically having a single 5-unit cycle period, two 4-unit cycle periods, three 3-unit cycle periods, and so on. The maximum length of the sequence is $2^N-1$, where N is the sequence order. The maximum length of the cycle period for given unit time is related to the length of the accumulation region along the beam axis, and to the length of the detector. Existing orthogonal axis systems may use, for example, detectors of about 35 mm, although detectors of up to 100 mm or more may be available. The minimum accumulation period corresponds to the lowest signal at the detector, while the maximum accumulation period corresponds with the highest signal-to-noise ratio. A fifth-order MLPRS may have a total length of 31 accumulation units, and allows a reasonable matrix inversion.

Figure 7:
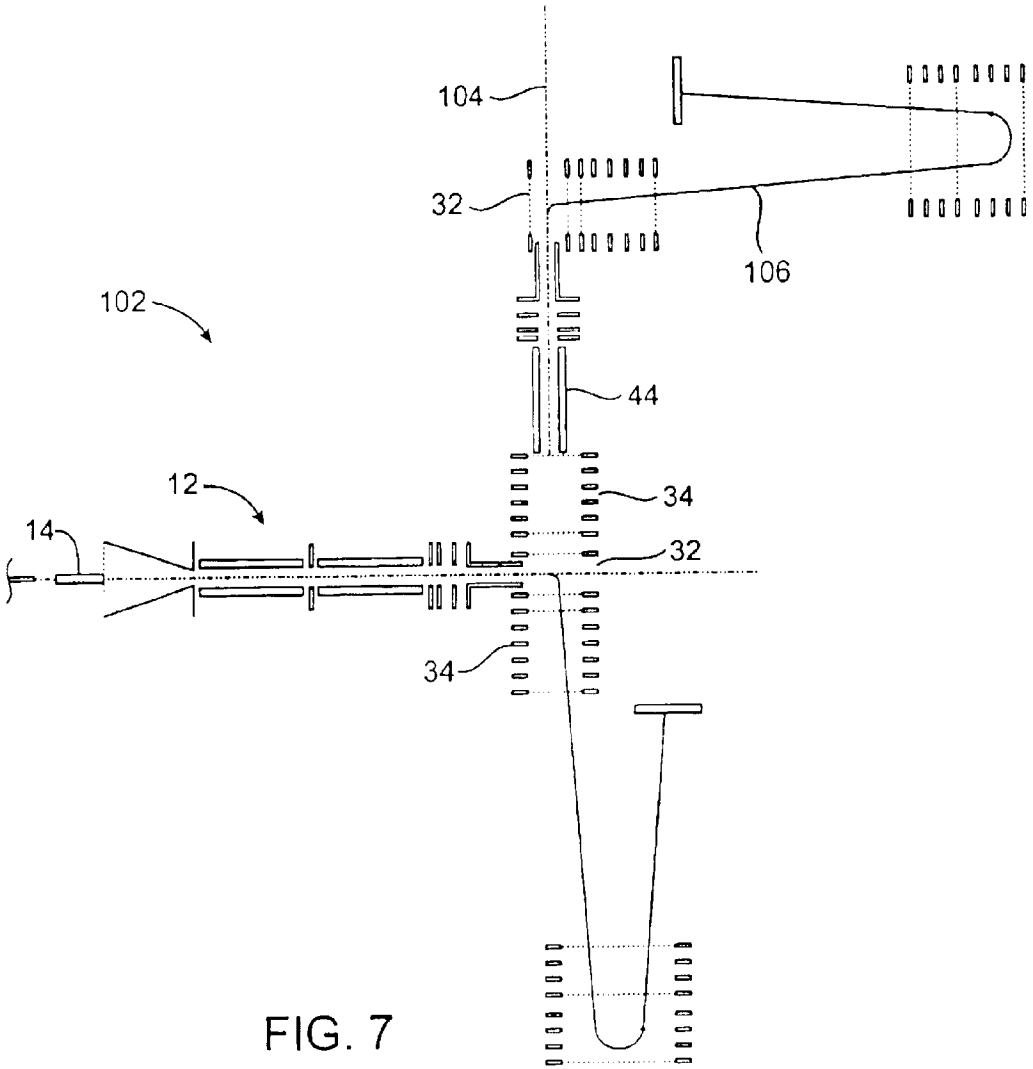
FIG. 7 schematically illustrates a tandem mass analyzer having dual multiplexing orthogonal axis time-of-flight analyzer stages according the principles of the present invention.

Still further modification and enhancements are also possible, including those illustrated in FIG. 7. A tandem mass spectrometry system 102 includes an analyzer 12 substantially as described above. However, an additional set of extraction electrodes 34 allows the ion beam to be deflected along a secondary beam axis 104. A multiple ion guide 44 along secondary axis 104 may be used to effect collision-induced dissociation of ions for subsequent analysis along a secondary time-of-flight flight path 106. Hence, if additional information is desired on a sequence of a detected protein or peptide, the parent ions may be fragmented and the spectra of the daughter ions further analyzed for more determinative characterization of the sample.

While the exemplary embodiments have been described in some detail, by way of example and for clarity of understanding, those of skill in the art will recognize that a variety of modification, adaptations, and changes may be employed. Hence, the scope of the present invention should be limited solely by the appending claims.

What is claimed is:

1. A method for analyzing an ion beam from a sample, the method comprising:

accumulating ions from the beam for a sequence of accumulation time periods, wherein the accumulation time periods of the sequence are the same;

accelerating the accumulated ions of each accumulation period in an associated ion packet;

detecting the accelerated ions at a detector, wherein ions of sequential packets are intermingled at the detector; and characterizing the sample with the intermingled detected ions of the sequential packets.

2. The method of claim 1, wherein the characterizing step comprises applying an inverse matrix, the inverse matrix an inverse of a matrix corresponding to a simplex matrix of the sequence with values modified in correlation with the accumulation periods.

3. The method of claim 1, wherein the characterizing step comprises applying an inverse Hadamard transform matrix.

4. The method of claim 1, further comprising repeating the accumulating, accelerating, and detecting steps for a plurality of sequences, wherein the accelerated ions travel along a flight path such that flight times of the ions to the detector vary. with characteristics of the ions, and wherein the characterizing step comprises recovering a mass spectrum of at least one sequence from the intermingled ions.

5. The method of claim 4, wherein each sequence defines a scan, and wherein the characterizing step further comprises summing a plurality of scans.

6. The method of claim 4, wherein the summed scans have differing sequences.

7. The method of claim 1, wherein the ion beam is oriented along an axis, and wherein the accelerated ions travel along a flight path, the flight path laterally oriented relative to the axis.

8. The method of claim 1, wherein the ion beam travels along a first axis from an ion source, and wherein the accelerating step comprises extracting the ions along a second axis orthogonal relative to the first axis.

9. The method of claim 8, wherein an accumulation region extends along the first axis, wherein the detector detects arrival of the ions onto a detector surface extending along the first axis and across a flight path of the ions.

10. The method of claim 9, wherein the driving of the ions comprises accelerating the ions along the second path using an orthogonal acceleration potential applied after each of the time periods of the sequence, and wherein the detector is positioned along the ion flight path at an ion focal length defined by the acceleration potential and the spacings between plates of the acceleration electrode.

11. The method of claim 9, wherein an ion reflector is disposed along the ion flight path between the accumulation region and the detector.

12. The method of claim 1, further comprising directing ions along a path of the ion beam to an accumulation region with first and second multi-pole rf-ion guides at differing ambient pressures.

13. The method of claim 12, wherein the first multi-pole ion guide provides collisional focusing of the ions of the beam, and wherein a second multi-pole ion guide selectively filters at least a portion of the ions of the beam.

14. The method of claim 13, wherein filtering of the ions is varied in response to detecting of the ions in a feedback loop.

15. The method of claim 12, further comprising desolvating the ion beam in a heated capillary, focusing the desolvated ion beam toward a first multiple-pole ion guide, steering the ion beam along the axis of the beam into the accumulation region, and decreasing ambient pressures along the ion beam with a plurality of pump-down stages.

16. The method of claim 1 further comprising characterizing the sample by building a scan vector from a combination of a plurality of sequences.

17. The method of claim 16, further comprising summing the plurality of sequences to form the scan vector.

18. The method of claim 16, further comprising applying a weighted matrix to the signal, the matrix weighted in accordance with accumulation time periods derived from the scan vector.

19. The method of claim 18, wherein the accumulation time periods derived from the scan vector are not the same as the accumulation time periods of the sequence.

* * * * *